US006495507B1

(12) United States Patent
Arvanitidou

(10) Patent No.: US 6,495,507 B1
(45) Date of Patent: Dec. 17, 2002

(54) HIGH FOAMING, GREASE CUTTING LIGHT DUTY LIQUID DETERGENT

(75) Inventor: Evangelia Arvanitidou, Kendall Park, NJ (US)

(73) Assignee: Colgate-Palmolive Co., Piscataway, NJ (US)

( * ) Notice: Subject to any disclaimer, the term of this patent is extended or adjusted under 35 U.S.C. 154(b) by 0 days.

(21) Appl. No.: 10/144,085

(22) Filed: May 13, 2002

(51) Int. Cl.[7] ..... C11D 17/00

(52) U.S. Cl. ..... 510/424; 510/426; 510/477; 510/490; 510/492

(58) Field of Search ..... 510/424, 426, 510/477, 490, 492

(56) References Cited

U.S. PATENT DOCUMENTS 6,451,333 * 9/2002 Beerse et al. ..... 424/405

* cited by examiner

*Primary Examiner*—Necholus Ogden
(74) *Attorney, Agent, or Firm*—Richard E. Nanfeldt

(57) ABSTRACT

A light duty, liquid comprising: two sulfonate surfactants, an ethoxylated alkyl ether sulfate, an amphoacetate, an alpha hydroxy aliphatic acid, a sulfoacetate and water.

4 Claims, No Drawings

HIGH FOAMING, GREASE CUTTING LIGHT DUTY LIQUID DETERGENT

Background of the Invention

The present invention relates to novel light duty liquid detergent compositions with improved foaming and good grease cutting properties as well as disinfecting properties.

The prior art is replete with light duty liquid detergent compositions containing nonionic surfactants in combination with anionic and/or betaine surfactants wherein the nonionic detergent is not the major active surfactant. In U.S. Pat. No. 3,658,985 an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8 to 20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition containing an alkali metal silicate, urea, glycerin, triethanolamine, an anionic detergent and a nonionic detergent. The silicate content determines the amount of anionic and/or nonionic detergent in the liquid cleaning composition. However, the foaming properties of these detergent compositions are not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to affect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contain an active ingredient mixture wherein the nonionic detergent is present in major proportion which is probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

SUMMARY OF THE INVENTION

It has now been found that a high foaming liquid detergent properties can be formulated with an alkali metal salt of a linear alkyl benzene sulfonate, a magnesium salt of a linear alkyl benzene sulfonate, an alkali metal salt of an ethoxylated alkyl ether sulfate, an alkali metal salt of an alkyl sulfoacetate, an alkali metal salt of an alkyl amphoacetate, an alpha hydroxy aliphatic acid and water.

Accordingly, one object of this invention is to provide novel, high foaming, and grease cutting light duty liquid detergent compositions which has antibacterial properties.

To achieve the foregoing and other objects and in accordance with the purpose of the present invention, as embodied and broadly described herein the novel, high foaming, light duty liquid detergent of this invention comprises an alkali metal salt of a linear alkyl benzene sulfonate, a magnesium salt of a linear alkyl benzene sulfonate, an alkali metal salt of an ethoxylated alkyl ether sulfate, an alkali metal salt of an alkyl sulfoacetate, an alkali metal salt of an alkyl amphoacetate, an alpha hydroxy aliphatic acid, an alkali metal salt of a linear alkyl benzene sulfonate, a magnesium salt of a linear alkyl benzene sulfonate, an alkali metal salt of an ethoxylated alkyl ether sulfate, an alpha hydroxy aliphatic acid and water, wherein the composition does not contain a glycol ether solvent, an ethoxylated and/or propoxylated nonionic surfactant, amine oxide, alkyl polyglucoside, a mono- or di-saccharides, a polyoxyalkylene glycol fatty acid, a builder, a polymeric thickener, a clay, abrasive, silicas, tricloscan, alkaline earth metal carbonates, alkyl glycine surfactant or cyclic imidinium surfactant.

DETAILED DESCRIPTION OF THE INVENTION

The present invention relates to a light duty liquid composition which comprises approximately by weight:

(a) 4% to 16% of an alkali metal salt of a linear alkyl benzene sulfonate surfactant;

(b) 4% to 16% of a magnesium salt of a linear alkyl benzene sulfonate;

(c) 6% to 20% of an ethoxylated alkyl ether sulfate surfactant;

(d) 0.5% to 10% of an alkali metal salt of an alkyl sulfoacetate;

(e) 0.5% to 10% of an alkali metal salt of an alkyl amphoacetate;

(f) 0.1% to 5% of an alpha hydroxy aliphatic acid; and (g) the balance being water wherein the composition does not contain a glycol ether solvent, an amine oxide, a polyglucoside, an ethoxylated and/or propoxylated nonionic surfactant, a zwitterionic surfactant, a polyoxyalkylene glycol fatty acid, a mono- or di-saccharides, a builder, a polymeric thickener, a clay, abrasive, silicas, triclosan, alkaline earth metal carbonates, alkyl glycine surfactant or cyclic imidinium surfactant.

Another light duty liquid composition of the instant invention comprises approximately by weight:

(a) 2% to 16% of an alkali metal salt of a linear alkyl benzene sulfonate surfactant;

(b) 2% to 16 of a magnesium salt of a linear alkyl benzene sulfonate surfactant;

(c) 0.1% to 16%, preferably 0.1% to 14% of a surfactant selected from the group consisting of an ethoxylated alkyl ether sulfate surfactant, and a paraffin sulfonate surfactant;

(d) 0 to 28%, more preferably 5% to 26% of an alpha olefin sulfonate surfactant;

(e) 2% to 14% of an alkali metal salt of an alkyl sulfoacetate;

(f) 0.1% to 5% of an alpha hydroxy aliphatic acid;

(g) the balance being water, wherein the composition does not contain an amine oxide, a polyglucoside glycol ether solvent, an ethoxylated and/or propoxylated non-ionic surfactant, a polyoxyalkylene glycol fatty acid, a mono- or di-saccharides, a builder, a polymeric thickener, a clay, abrasive, silicas, triclosan, alkaline earth metal carbonates, alkyl glycine surfactant or cyclic imidinium surfactant.

The alkali metal or ammonium salt of an ethoxylated alkyl ether sulfate which can be used in the instant composition is depicted by the formula:

$$R—(OCHCH_2)_nOSO_3M$$

wherein n is about 1 to about 10, more preferably 1 to 3 and R is an alkyl group having about 8 to about 18 carbon atoms, more preferably 12 to 15 and natural cuts, for example, $C_{12-14}$; $C_{12-15}$ and M is a metal or ammonium cation most preferably sodium or ammonium. The most preferred embodiment is R is $C_{12-14}$ and X=1 to 3.

The ethoxylated alkyl ether sulfate surfactant is present in the composition at a concentration of about 8 to 16 wt. %, more preferably about 9 to 15 wt. %.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule also are suitable for use in the invention compositions. These surfactants can be prepared by reacting an alkyl phenol with 2 to 6 moles of ethylene oxide and sulfating and neutralizing the resultant ethoxylated alkylphenol. Examples of suitable alkali metal salts and magnesium salts of sulfonated anionic surfactants are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_{8-C15}$ alkyl phenol sulfonates.

A preferred sulfonate is linear alkyl benzene sulfonate having a high content of 3- (or higher) phenyl isomers and a correspondingly low content (well below 50%) of 2-(or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

The $C_{12-C20}$ paraffin sulfonates which can be used more preferably 4 wt. % to 14 wt. % in the instant compositions may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744 and 3,372,188 and also in German Patent 735,096. Such compounds may be made to specifications and desirably the content of paraffin sulfonates outside the $C_{14-17}$ range will be minor and will be minimized, as will be any contents of di- or poly-sulfonates.

The present invention also optionally contain an alpha olefin sulfonates, including long-chain alkene sulfonates, long-chain hydroxyalkane sulfonates or mixtures of alkene sulfonates and hydroxyalkane sulfonates. These alpha olefin sulfonate surfactants may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred alpha olefin sulfonates contain from 14 to 16 carbon atoms in the R alkyl group and are obtained by sulfonating an a-olefin.

The alkali metal salt of an alkyl sulfoacetate which can be used in the instant composition has the formula:

$$CH_3(CH_2)_xCH_2O\overset{\overset{\displaystyle O}{\|}}{C}CH_2SO_3^-Na^+$$

wherein x is a number from 8 to 16, preferably 9 to 14, wherein x is most preferably 10. A preferred sulfoacetate is Lalhanol® LAL available from Stephan and is sodium lauryl sulfoacetate.

The alkali metal salt of an alkyl amphoacetate which can be used in the instant composition has the formula:

$$RC\overset{\overset{\displaystyle O}{\|}}{}—NH—CH_2CH_2—\overset{\overset{\displaystyle CH_2CH_2OH}{|}}{N}—CH_2COO^-\ Na^+$$

wherein R is an alkyl group having 8 to 16 carbon atoms, preferably 10 to 14 and most preferably 12. Amphosol® 1C from Stephan Chemical is preferred and is sodium cocoamphoacetate.

The alpha hydroxy aliphatic acid is selected from the group consisting of lactic acid, salicylic acid, orthohydroxy benzoic acid, citric acid and glycolic and mixtures thereof.

The water is present at a concentration of 40 wt. % to 83 wt. %.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pH modifiers; etc. The proportion of such adjuvant materials, in total will normally not exceed 15% by weight of the detergent composition, and the percentages of most of such individual components will be a maximum of 5% by weight and preferably less than 2% by weight. Sodium formate or formalin or Quaternium15 (Dowcil75) can be included in the formula as a perservative at a concentration of 0.1 to 4.0 wt. %. Sodium bisulfite can be used as a color stabilizer at a concentration of 0.01 to 0.2 wt. %.

The present light duty liquid detergents such as dishwashing liquids are readily made by simple mixing methods from readily available components which, on storage, do not adversely affect the entire composition. Solubilizing agent such as a $C_{1-C3}$ alkanol such as ethanol, an alkali metal chloride such as sodium chloride and/or sodium cumene or sodium xylene sulfonate are used to assist in solubilizing the surfactants. The sodium cumene or xylene sulfonate is present at a concentration of 0 to 3 wt. %, more preferably 0.25 wt. % to 2 wt. %. The viscosity of the light duty liquid composition desirably will be at least 100 centipoises (cps) at room temperature, but may be up to 1,000 centipoises as measured with a Brookfield Viscometer using a number 21 spindle rotating at 20 rpm. The viscosity of the light duty liquid composition may approximate those of commercially acceptable light duty liquid compositions now on the market. The viscosity of the light duty liquid composition and the light duty liquid composition itself remain stable on storage for lengthy periods of time, without color changes or settling out of any insoluble materials. The pH of the composition is 3 to 5.5 and preferably 3.2 to 5.0. The pH of the composition can be adjusted by the addition of sulfuric acid to the composition.

The instant compositions have a minimum foam volume of 350 mls after 40 rotations at room temperature as measured by the foam volume test using 0.0333 wt. % of the Ultra composition in 150 ppm of water. The foam test is an inverted cylinder test in which 100 gr. of a 0.0333 wt. % LDL formula in 150 ppm of $H_{20}$ is placed in a stoppered graduate cylinder (500 ml) and inverted 40 cycles at a rate of 30 cycles/minute. After 40 inversions, the foam volume which has been generated is measured in mls inside the graduated cylinder. This value includes the 100 ml of LDL solution inside the cylinder. After the initial volume is measured, 175 microliters of whole milk is added to the solution. The cylinder is then inverted for another 40 cycles and a foam volume with soil is measured; the foam volume after the soil addition is at least 140 mls. The values provided above include the 100 ml's of LDL solution inside the cylinder. The Cup test measures the grease removal under soaking conditions. 6 gr of warm liquid beef tallow is applied on a 250 ml plastic cup. It is allowed to solidify for at least 3 hours. Warm solutions(115F) of LDL products at 0.267% concentration were poured on the plastic cups containing the grease. After 15 minutes they are emptied, and allowed to dry. The weight of the grease removed during soaking is measured.

The following examples illustrate liquid cleaning compositions of the described invention. Unless otherwise specified, all percentages are by weight. The exemplified compositions are illustrative only and do no limit the scope of the invention. Unless otherwise specified, the proportions in the examples and elsewhere in the specification are by weight.

DESCRIPTION OF THE PREFERRED EMBODIMENTS

EXAMPLE 1

The following formulas in wt. % were prepared at room temperature by simple liquid mixing procedures as previously described

| | A % | B % | Reference formula |
|---|---|---|---|
| MgLas | 11.67 | 11.67 | 9.00 |
| NaLas | 11.66 | 11.67 | 3.00 |
| AEOS 1.3EO | 11.67 | 11.67 | 11.64 |
| Lathanol LAL | 5.00 | 0.00 | 0.00 |
| Amphosol IC | 0.00 | 5.00 | 0.00 |
| Lactic acid | 2.00 | 2.00 | 0.00 |
| APG | 0.00 | 0.00 | 10.00 |
| CAP amine oxide | 0.00 | 0.00 | 6.34 |
| Minors | 58.00 | 58.00 | 60.00 |
| pH | 3.5 | 3.5 | 6.75 |
| Cup test (scale) | 136 | 194 | 100 |
| Shake I (ml) | 411.7 | 375 | 347.5 |
| Shake F (ml) | 175 | 146.7 | 143.3 |

EXAMPLE 2

The following formulas in wt. % were prepared at room temperature by simple liquid mixing procedures as previously described

| | A % | B % | C % | D % | Current formula (D100) |
|---|---|---|---|---|---|
| MgLas | 11.67 | 0.00 | 5.83 | 10.0 | 9.00 |
| NaLas | 11.66 | 0.00 | 5.83 | 10.0 | 3.00 |
| AEOS 1.3EO | 11.67 | 0.00 | 23.34 | 10.0 | 11.64 |
| Paraffin sulfonate | 0.00 | 11.67 | 0.00 | 0.0 | 0.00 |
| Alpha olefin sulfonate | 0.00 | 23.34 | 0.00 | 0.0 | 0.00 |
| Lathanol LAL | 5.00 | 5.00 | 5.00 | 10.0 | 0.00 |
| Lactic acid | 2.00 | 2.00 | 2.00 | 2.0 | 0.00 |
| APG | 0.00 | 0.00 | 0.00 | 0.0 | 10.00 |
| CAP amine oxide | 0.00 | 0.00 | 0.00 | 0.0 | 6.34 |
| Minors | 58.00 | 58.00 | 58.00 | 0.0 | 60.00 |
| pH | 3.5 | 3.5 | 3.5 | 0.0 | 6.75 |
| Shake I (ml) | 411.7 | 375 | 413.3 | 426.7 | 343.3 |
| Shake F (ml) | 161 | 168.3 | 166.7 | 173 | 145 |

What is claimed is:

1. A light duty liquid dishwashing detergent composition comprising approximately by weight:

(a) 4% to 16% of an alkali metal salt of a linear alkyl benzene sulfonate surfactant;

(b) 4% to 16% of a magnesium salt of a linear alkyl benzene sulfonate;

(c) 6% to 20% of an ethoxylated alkyl ether sulfate surfactant;

(d) 0.5% to 10% of an alkali metal salt of an alkyl sulfoacetate;

(e) 0.5% to 10% of an alkali metal salt of an alkyl amphoacetate;

(f) 0.1% to 5% of an alpha hydroxy aliphatic acid; and (g) the balance being water wherein the composition does not contain an amine oxide, a polyglucoside glycol ether solvent, an ethoxylate and/or propoxylated nonionic surfactant, a polyalkylene glycol fatty acid, a mono- or di-saccharides, a builder, a polymeric thickener, a clay, abrasive, silicas, triclosan, alkaline earth metal carbonates, alkyl glycine surfactant or cyclic imidinium surfactant.

2. A light duty liquid composition according to claim 1 which includes, in addition, a solubilizing agent selected from the group consisting of a $C_1$–$C_4$ alkanol, an alkali metal chloride and is ethanol, sodium chloride, a water soluble salts of $C_1$–$C_3$ substituted benzene sulfonate hydrotropes and mixtures thereof.

3. A light duty liquid composition according to claim 1 further including a preservative.

4. A light duty liquid composition according to claim 1 further including a color stabilizer.

* * * * *